US010415932B1

(12) United States Patent
Greenslade et al.

(10) Patent No.: US 10,415,932 B1
(45) Date of Patent: Sep. 17, 2019

(54) ADJUSTABLE WEAPON-BASED MOUNT FOR A MONOCULAR NIGHT-VISION GOGGLE

(71) Applicant: Knight Vision LLLP, Titusville, FL (US)

(72) Inventors: Kenneth R. Greenslade, Mims, FL (US); Nathan M. Adair, Orlando, FL (US)

(73) Assignee: Knight Vision LLLP, Titusville, FL (US)

( * ) Notice: Subject to any disclaimer, the term of this patent is extended or adjusted under 35 U.S.C. 154(b) by 351 days.

(21) Appl. No.: 15/217,931

(22) Filed: Jul. 22, 2016

(51) Int. Cl.
*F41G 1/38* (2006.01)
*F41G 11/00* (2006.01)

(52) U.S. Cl.
CPC ..... *F41G 1/38* (2013.01); *F41G 11/003* (2013.01)

(58) Field of Classification Search
CPC ..... F41G 1/38; F41G 11/003; F41G 11/004; F41G 11/005; F41G 1/32; F41G 11/00
USPC ..... 42/124
See application file for complete search history.

(56) References Cited

U.S. PATENT DOCUMENTS 4,092,793 A 6/1978 Ricks
4,934,085 A * 6/1990 Lough ..... F41G 11/003 42/124
5,430,967 A * 7/1995 Woodman, III ..... F41G 1/35 362/110
5,471,678 A 12/1995 Dor
6,438,888 B1 * 8/2002 Lin ..... F41G 1/34 362/110
6,606,813 B1 * 8/2003 Squire ..... F41C 27/00 248/201
6,637,144 B2 10/2003 Nelson et al.
6,922,934 B1 * 8/2005 Huan ..... F41G 11/003 42/127
7,308,772 B1 * 12/2007 Millett ..... F41G 11/003 42/124
7,685,759 B2 * 3/2010 Teetzel ..... F41G 11/003 42/127

(Continued)

OTHER PUBLICATIONS

Information from Larue website (www.larue.com) for PVS-14 QD pivot mount LT755-14.

(Continued)

*Primary Examiner* — Joshua E Freeman
*Assistant Examiner* — Bridget A Cochran
(74) *Attorney, Agent, or Firm* — Opticus IP Law PLLC

(57) ABSTRACT

A rotatably adjustable mount for removably mounting an NV monocular onto a weapon is disclosed. The mount has a base and a rotatable side fixture. The base is configured to clip onto a rail on the weapon. The side fixture has a battery section, an electronics section and a lever section. The battery section supports a battery. The electronics section is electrically connected to the battery section and includes power-management electronics. The lever section locks and unlocks the NV goggle to the side fixture. The side fixture has a slot configured to receive an NV mounting fixture of the NV monocular and establish electrical contact between the electronics section and the NV monocular. The side fixture is rotatable between an in-line position and an out-of-line position of a downstream day sight supported by the weapon. A night-vision weapon sight that employs the mount is also disclosed.

12 Claims, 16 Drawing Sheets

(56) References Cited

U.S. PATENT DOCUMENTS 7,735,255 B1 * 6/2010 Kincaid ..... F41C 33/0254 362/110
7,802,395 B1 * 9/2010 Swan ..... F41G 11/003 403/374.5
7,886,476 B1 * 2/2011 Swan ..... F41C 27/00 403/374.5
7,905,045 B1 * 3/2011 Swan ..... F41G 11/003 403/374.5
7,908,782 B1 * 3/2011 LaRue ..... F41G 11/008 42/124
7,975,419 B2 * 7/2011 Darian ..... F41G 11/003 42/84
8,056,277 B2 * 11/2011 Griffin ..... F41C 23/16 42/71.01
8,091,265 B1 * 1/2012 Teetzel ..... F41C 23/16 42/124
8,104,211 B2 * 1/2012 Darian ..... F41C 23/22 362/110
8,112,933 B1 * 2/2012 Swan ..... F41G 11/003 403/374.5
8,132,355 B1 * 3/2012 Kincaid ..... F41C 33/0254 362/110
8,505,229 B2 8/2013 Savoy et al.
8,510,983 B2 8/2013 Larue
8,850,735 B2 * 10/2014 Kenney ..... F41A 3/66 42/106
D728,722 S * 5/2015 Peterson ..... D22/108
D728,723 S * 5/2015 Peterson ..... D22/108
9,046,320 B2 * 6/2015 Keng ..... F41G 11/003
9,200,867 B1 * 12/2015 Swan ..... F41G 11/003
D747,780 S * 1/2016 Swan ..... D22/110
9,250,035 B2 * 2/2016 Sullivan ..... F41G 11/003
D756,763 S * 5/2016 Swan ..... D22/109
9,453,707 B2 * 9/2016 Williams ..... F41G 1/387
9,506,708 B2 * 11/2016 Peterson ..... F41A 11/02
10,030,939 B2 * 7/2018 Kowalczyk, Jr. ..... F41G 11/003
D826,363 S * 8/2018 Kowalczyk, Jr. ..... D22/109
10,047,941 B2 * 8/2018 Mock ..... F21V 23/003
2001/0022044 A1 * 9/2001 Spinner ..... F41G 11/001 42/124
2003/0101632 A1 * 6/2003 Davenport ..... F41G 11/004 42/85
2008/0034638 A1 * 2/2008 Spuhr ..... F41G 11/006 42/127
2010/0107467 A1 * 5/2010 Samson ..... F41G 11/003 42/127
2010/0229449 A1 * 9/2010 Matthews ..... F41G 11/003 42/90
2010/0229450 A1 * 9/2010 Becker ..... F41C 23/14 42/90
2011/0061286 A1 * 3/2011 Wang ..... F41G 11/003 42/125
2011/0173865 A1 * 7/2011 Compton ..... F41G 11/003 42/84
2011/0283585 A1 * 11/2011 Cabahug ..... F41C 23/22 42/73
2012/0180363 A1 7/2012 Frascati et al.
2013/0180155 A1 7/2013 He et al.
2014/0137457 A1 5/2014 Collin et al.

OTHER PUBLICATIONS

Information from Wilcox website (www.wilcoxind.com) for aimpoint flip mount, Mini N-SEAS flip mount, and SKEETIRx/ UTM flip mount.

* cited by examiner

ADJUSTABLE WEAPON-BASED MOUNT FOR A MONOCULAR NIGHT-VISION GOGGLE

FIELD

The present disclosure relates to weapon sights, and in particular relates to an adjustable weapon-based mount for a monocular night-vision goggle.

BACKGROUND

Many types of weapons such as rifles have weapon sights that allow the weapon's user to view a target within a scene and align the weapon relative to the target, e.g., to select a bullet impact point. A typical weapon sight includes a cross-hair reticle. The weapon sight is adjusted ("aligned") so that the cross-hairs match the desired bullet impact point for a given target distance. The typical weapon sight is configured to mount to a military standard rail mount ("rail") (e.g., MIL-STD 1913) that runs along the top and/or side of the weapon (forend and barrel).

A "night sight" weapon sight is used for night vision, while a "day sight" weapon sight is used for day vision. Some weapon sights have combined night-vision and day-vision capability. In some cases, a night-vision optical system ("night optic") is used on a weapon in an in-line configuration in front of a primary day-vision optic system ("day optic") to provide combined night and day vision capability. This is commonly known as a clip-on weapon sight.

FIG. 1 is an elevated view of a helmet 6 that includes a helmet mounting fixture 8 configured to receive and hold a helmet-mounted monocular night optic or "NV goggle" 10. The helmet mounting fixture 8 is located at the front of helmet 6 and allows for the NV goggle 10 to be flipped into and out of the viewing position in front of a user's eye or eyes. Binocular night-optic goggles can be formed from two NV goggles 10 with appropriate modification of helmet mounting fixture 8.

Presently, a weapon-mountable (WM) night optic is designed specifically to operate on a weapon while a night optic such as NV goggle 10 is typically designed to operate on a helmet or to be carried separately as a hand-held device. This results in situations where a soldier or like user has to carry two separate night optics: one for the weapon and one for the helmet or to be held by hand. This increases the load-carrying burden on the user, who typically already carries an abundance of other items such as supplies, communication equipment, ammunition, power sources, etc. In addition, at night a helmet-mounted NV goggle 10 has to be flipped out of the way in order for the user to look through the weapon sight, which includes the WM (clip-on) night optic.

SUMMARY

An aspect of the disclosure is a weapon-based mount apparatus for mounting on a weapon having a rail a night-vision monocular goggle ("NV goggle") having a mounting fixture with a first electrical connector. The apparatus includes: a base configured to releasably mount to the rail of the weapon; and a side fixture rotatably mounted to a side of the base. The side fixture has: i) a battery section that operably supports a battery; ii) an electronics section electrically connected to the battery section and that includes power-management electronics electrically connected to a second electrical connector; iii) a slot configured to receive the mounting fixture so that first and second electrical connectors operably engage when the NV goggle is operably supported by the side fixture; and iv) a lever section configured to lock the NV goggle within the slot.

Another aspect of the disclosure is the apparatus described above, wherein the base includes a clip-on mechanism having a cam-based lever that is moveable to engage and disengage with the rail.

Another aspect of the disclosure is the apparatus described above, wherein the side fixture is attached to the base with a hinge mechanism so that the side fixture is rotatable by about 90 degrees relative to the base.

Another aspect of the disclosure is the apparatus described above, wherein slot has an open end, and wherein the electronics section includes a power switch that rotates between an off position and an on position, and wherein in the on position a portion of the power switch covers the open end of the slot.

Another aspect of the disclosure is the apparatus described above, wherein the top surface of the base includes a recess sized to accommodate a bottom portion of the NV goggle.

Another aspect of the disclosure is the apparatus described above, wherein the base includes a first latch feature and the side fixture includes a second latch feature, and wherein the first and second latch features are configured to releasably engage when the side fixture is at right angles to the base.

Another aspect of the disclosure is the apparatus described above, wherein the second latch feature is a spring-loaded.

Another aspect of the disclosure is the apparatus described above, wherein the lever section includes a locking lever that operably engages a spring-loaded locking device having a rod, and where the locking lever is configured to move an end of the rod into and out of the slot.

Another aspect of the disclosure is the apparatus described above, wherein the mounting fixture is configured to mount to a helmet mounting fixture.

Another aspect of the disclosure is night-vision weapon sight that includes the weapon-based mounting apparatus described above, and the NV goggle operably mounted to the weapon-based mount.

Another aspect of the disclosure is a weapon-sight system for a weapon having a rail, and that includes the weapon-based mounting apparatus described above and mounted to the rail; a NV goggle operably supported by the weapon-based mounting apparatus; and a day sight mounted to the rail in-line and downstream of the NV goggle.

Another aspect of the disclosure is the weapon-sight system as described above, and further including a wedge-prism assembly attached to a back end of the NV goggle.

Another aspect of the disclosure is an NV weapon sight that includes: an NV goggle having a mounting fixture with first electrical connector; a weapon-based mounting apparatus having a base with a side fixture rotatably mounted to the base; the side fixture having a slot that includes a second electrical connector and further including: i) a battery section configured to hold a battery; ii) an electrical section configured to provide an electrical connection between the battery section and the second electrical connector and iii) a lever section comprising a lever-based locking mechanism. The NV goggle is operably supported by the weapon-based mounting apparatus with a portion of the mounting fixture residing within the slot such that the first and second electrical connectors are operably connected. The lever-based locking mechanism releasable locks the NV goggle to the weapon-based mounting apparatus. The side fixture and the NV goggle secured therein are rotatable relative to the base between an up position and a down position.

Another aspect of the disclosure is the NV weapon sight described above, wherein the mounting fixture includes outer flange, and wherein the slot includes an outer section that closely accommodates the outer flange.

Another aspect of the disclosure is the NV weapon sight described above, and further including a hinge mechanism at one side of the base, wherein the hinge mechanism includes a spring-loaded pin that defines a hinge axis.

Another aspect of the disclosure is the NV weapon sight described above, wherein the base includes a first latching feature, the side fixture includes a second latching mechanism, and wherein the first and second latching mechanisms operably engage when the side fixture is place in the up position.

Another aspect of the disclosure is the NV weapon sight described above, wherein the first and second latching mechanisms operably disengage when the side fixture is moved relative to the base and parallel to the hinge axis and against a direction of force provided by the spring-loaded pin of the hinge mechanism.

Another aspect of the disclosure is the NV weapon sight described above, wherein the electronics section includes a top side having a power switch adjustable between an off position and on position, wherein in the on position, the power switch covers an open end of the slot to prevent the mounting fixture from being removed through the open end of the slot.

Another aspect of the disclosure is the NV weapon sight described above, wherein the base is configured to be releasable mounted to a rail of a weapon.

Another aspect of the disclosure is the NV weapon sight described above, wherein the lever section includes a spring-loaded locking device that mechanically engages and disengages with the mounting fixture of the NV goggle by moving a locking lever between a locked position and an unlocked position.

Another aspect of the disclosure is the NV weapon sight described above, further including a wedge-prism assembly removably attached to a back end of the NV goggle.

Another aspect of the disclosure is the NV weapon sight described above, wherein the mounting fixture is configured to mount to a helmet mounting fixture.

Another aspect of the disclosure is a method of forming a NV weapon-sight system for a weapon having a rail. The method includes: a) clipping to the rail a mount apparatus configured to rotatably support a night-vision monocular goggle in either an up position or a down position; and b) securing the night-vision monocular goggle to the mount apparatus.

Another aspect of the disclosure is the method described above, and further including prior to act b): removing the night-vision monocular goggle from a mounting fixture of a helmet.

Another aspect of the disclosure is the method described above, wherein the act a) includes disposing the mount apparatus in front of a day sight mounted to the rail.

Another aspect of the disclosure is the method described above, and further including after act b): removing the night-vision monocular goggle from the mount apparatus and mounting it to a mounting fixture of a helmet.

Another aspect of the disclosure is the method described above, wherein the mount apparatus includes a base, and wherein the act a) includes activating a cam-based lever to releasably secure the base to the rail.

Another aspect of the disclosure is the method described above, wherein the mount apparatus includes a base and a side fixture rotatably attached to a side of the base, wherein the side fixture has a battery section and includes a slot, and wherein the act b) of securing includes inserting an end-portion of a mounting fixture of the night-vision monocular goggle into the slot to establish an electrical power connection between the battery section of the side fixture and the night-vision monocular goggle.

Another aspect of the disclosure is a NV weapon-sight system for a weapon having a rail and that includes: a) a helmet-mounted NV goggle having an NV mounting fixture having a first electrical connector and configured to mount to a helmet mounting fixture on a helmet; and b) a mount apparatus that operably supports the NV goggle, the mount apparatus having a base that is removably mountable to the rail and that includes a side fixture rotatably attached to the base and that is rotatably between an up position and a down position, the side fixture defining a slot within which resides a second electrical connector and which operably receives the NV mounting fixture and that forms an electrical connection between the first and second electrical connectors.

Another aspect of the disclosure is the NV weapon-sight system described above, wherein the side fixture comprises: i) a battery section configured to support a battery; ii) an electronics section electrically connected to the battery section and that includes power-management electronics; and iii) a lever section configured to lock and unlock the NV goggle to the side fixture.

Another aspect of the disclosure is the NV weapon-sight system described above, wherein the base includes a throw-lever rail mounting mechanism.

Another aspect of the disclosure is the NV weapon-sight system described above, and further including a wedge-prism assembly removably attached to a back end of the NV goggle.

Additional features and advantages are set forth in the Detailed Description that follows, and in part will be readily apparent to those skilled in the art from the description or recognized by practicing the embodiments as described in the written description and claims hereof, as well as the appended drawings. It is to be understood that both the foregoing general description and the following Detailed Description are merely exemplary and are intended to provide an overview or framework to understand the nature and character of the claims.

BRIEF DESCRIPTION OF THE DRAWINGS

The accompanying drawings are included to provide a further understanding and are incorporated in and constitute a part of this specification. The drawings illustrate one or more embodiments, and together with the Detailed Description serve to explain principles and operation of the various embodiments. As such, the disclosure will become more fully understood from the following Detailed Description, taken in conjunction with the accompanying Figures, in which.

DETAILED DESCRIPTION

Reference is now made in detail to various embodiments of the disclosure, examples of which are illustrated in the accompanying drawings. Whenever possible, the same or like reference numbers and symbols are used throughout the drawings to refer to the same or like parts. The drawings are not necessarily to scale, and one skilled in the art will recognize where the drawings have been simplified to illustrate the key aspects of the disclosure.

The claims as set forth below are incorporated into and constitute a part of this detailed description.

The entire disclosure of any publication or patent document mentioned herein is incorporated by reference, including U.S. Pat. No. 7,142,357, entitled "Night-Day boresight with adjustable wedge-prism assembly" (hereinafter, the '357 patent).

In the discussion below, a "user" (denoted U) refers to a person who uses the weapon-based mount as disclosed herein and/or a weapon-sight system that employs the weapon-based mount on a weapon, with example users including soldiers, paramilitary personnel, law-enforcement personnel (e.g., police, FBI, DEA, SWAT members) and civilians (e.g., sportsman, hunters, etc.).

Cartesian coordinates are used in some of the Figures for the sake of illustration and for ease of discussion and are not intended to be limiting as to direction or orientation. Likewise, the terms "horizontal" and "vertical" and "upper" and "lower" and "top" and "bottom," etc. are used for convenience with reference to the Cartesian coordinates and are not intended to be limiting as to direction or orientation. In the Figures, the viewing direction is in the +z direction.

The terms "downstream" and "upstream" are terms used in the art of optics to refer to the location of an item relative to direction in which light travels, wherein the expression "A is downstream of B" means that B receives the light before A receives the light. Likewise, the expression "A is upstream of B" means that A is first to receive the light.

The term NV goggle as used herein includes a monocular helmet-mounted night-vision goggle as well as a hand-held night-vision monocular.

The term helmet mounting fixture refers to a mounting fixture that is supported by a helmet. The term NV mounting fixture refers to a mounting fixture that is supported by the NV goggle.

The term weapon-based mount means a mount apparatus that can be attached to a weapon, and in particular includes a mount apparatus that can be removably attached to the rail of a weapon.

The terms "day sight" an "day optic" are used interchangeable herein.

NV Goggle

Figure 1:
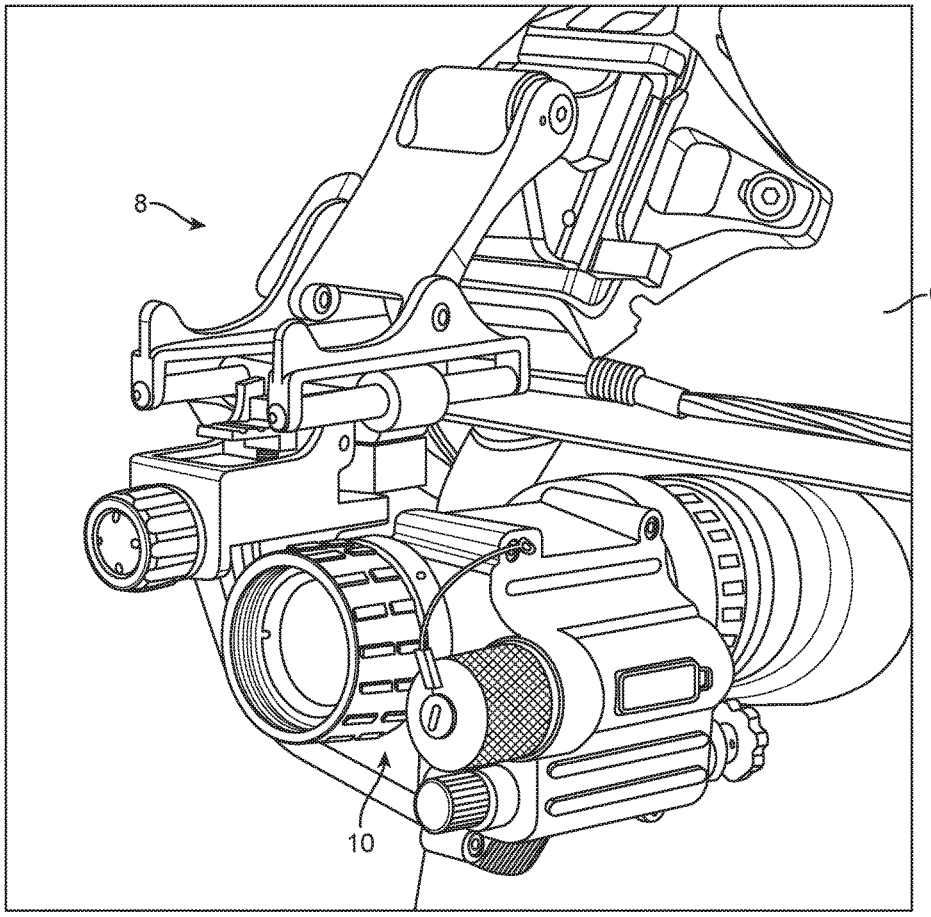
FIG. 1 (PRIOR ART)
FIG. 1 is an elevated view of a helmet that includes a mount configured to hold a NV goggle.
Figure 2A:
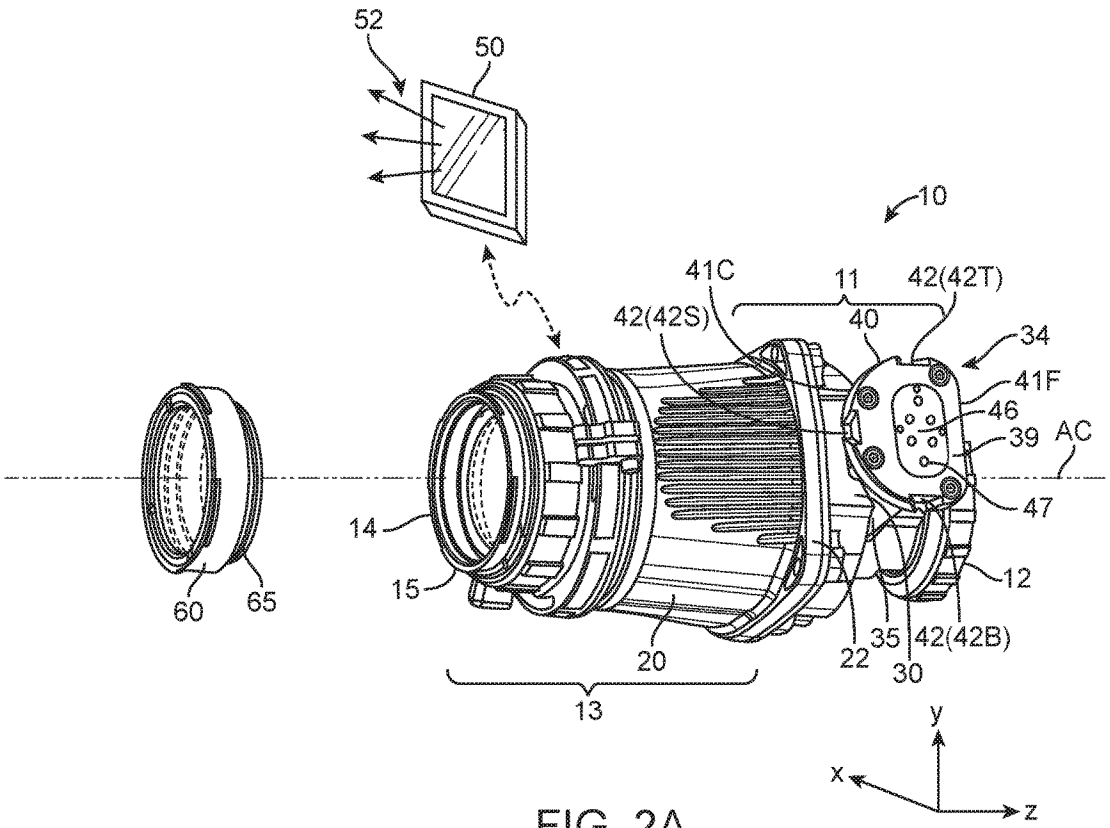
FIG. 2A is a side elevated view of an example NV goggle along with a wedge-prism assembly, with the close-up inset showing a display within the NV goggle that generates a night-vision display image.
Figure 2B:
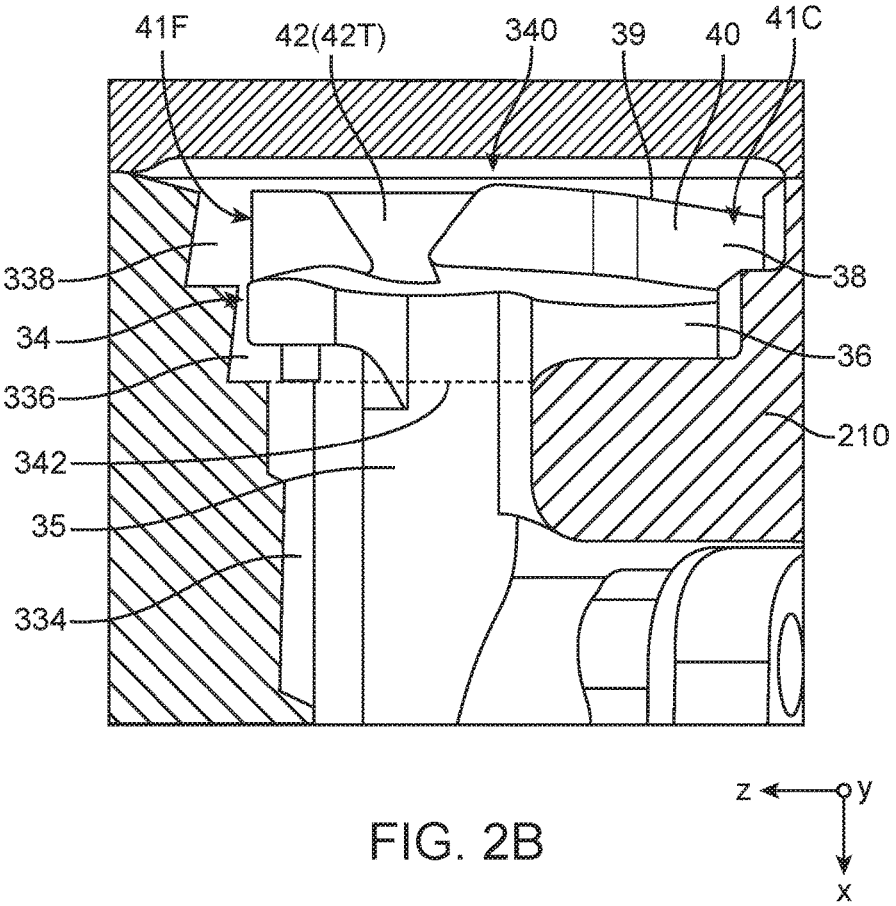
FIG. 2B is a close-up top-down view of the mounting fixture of the NV goggle that resides in a slot of the adjustable weapon-based mount as disclosed herein.

FIG. 2A is a side elevated view of an example NV goggle 10 such as shown in FIG. 1. The NV goggle 10 includes a central axis AC, a front end section 11 that includes front-end 12 section, and back end section 13 that includes a back end 14. The NV goggle 10 also includes a bottom 20 and a side 30. The front-end section 11 includes a flange 22 that lies in an x-y plane. The front-end section 11 includes at side 30 a NV mounting fixture 34 that extends from side 30 in the x-direction. FIG. 2B is a close-up top-down view of NV mounting fixture 34. The mounting fixture includes an arm 35 that extends in the x-direction and that is terminate by an inner flange 36 and an outer flange 38 that is larger than the inner flange. The NV goggle 10 of FIG. 2A is configured to be mounted to helmet mounting fixture 8 of helmet 6 using NV mounting fixture 34.

The outer flange 38 has front surface 39 and a perimeter 40. In an example, the flange perimeter 40 has a curved portion 41C and flat portion 41F. In an example, flange perimeter 40 includes one or more notches 42. In the example shown in FIG. 2A, there is a top notch 42T, a side notch 42S and a bottom notch 42B. The front surface 39 of flange 38 includes a first electronical connector 46, e.g., a female or receptacle connector having at least one electrical connection features 47 such as one or more electrical ports or one or more electrical contacts.

The NV goggle 10 also includes a display 50 along with a number of other internal components known in the art of night-vision optical systems and so are not shown. The display 50 displays a night-vision display image 52, as shown in the close-up inset of FIG. 2A. In an example, display 50 comprises a photocathode, a microchannel plate and a phosphor screen. The back end 14 of NV goggle 10 is configured to receive and hold an optional wedge-prism assembly 60. The wedge-prism assembly 60 when properly adjusted serves to correct the display-image position of NV goggle 10 and maintain the boresight when used in combination and in-line with a day sight. In an example, the back end 14 of NV goggle 10 includes threads 15 used to receive and engage corresponding threads 65 of wedge-prism assembly 60.

Adjustable Weapon-Based Mount

Figure 3A:
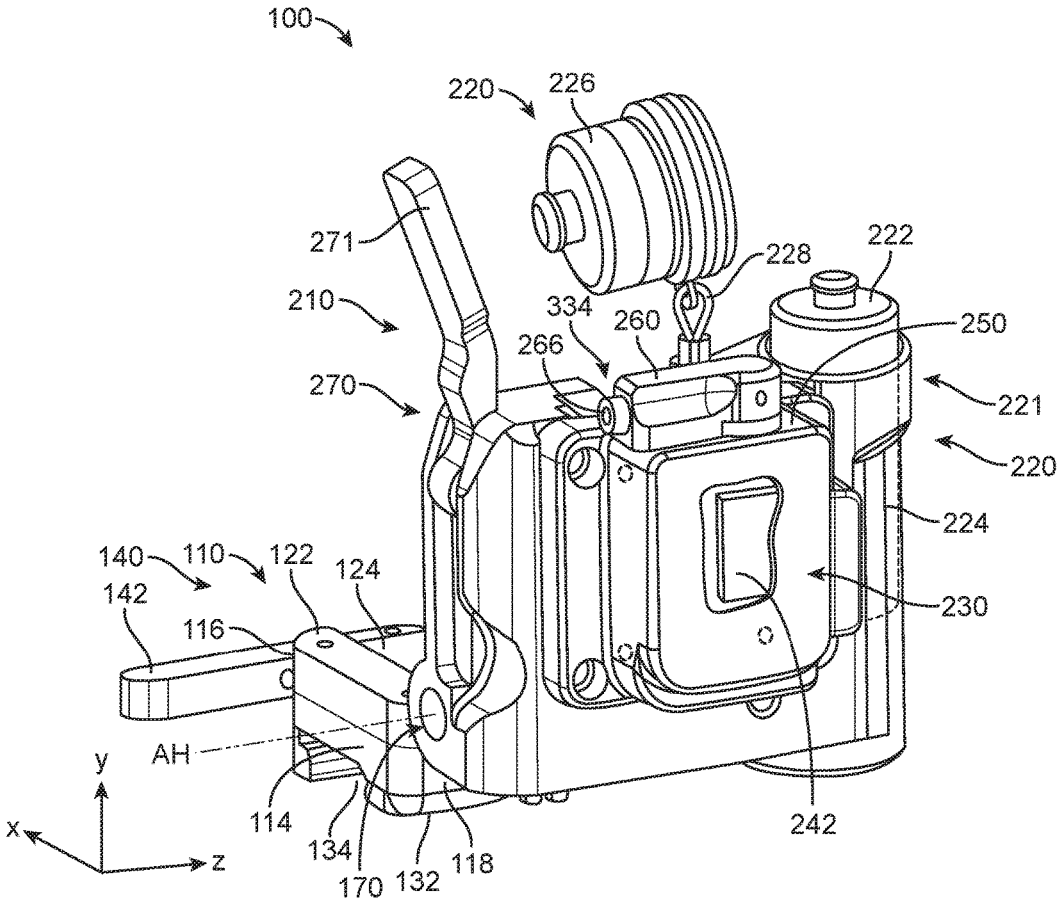
FIG. 3A is a side elevated view of an example adjustable weapon-based mount as disclosed herein.
Figure 3B:
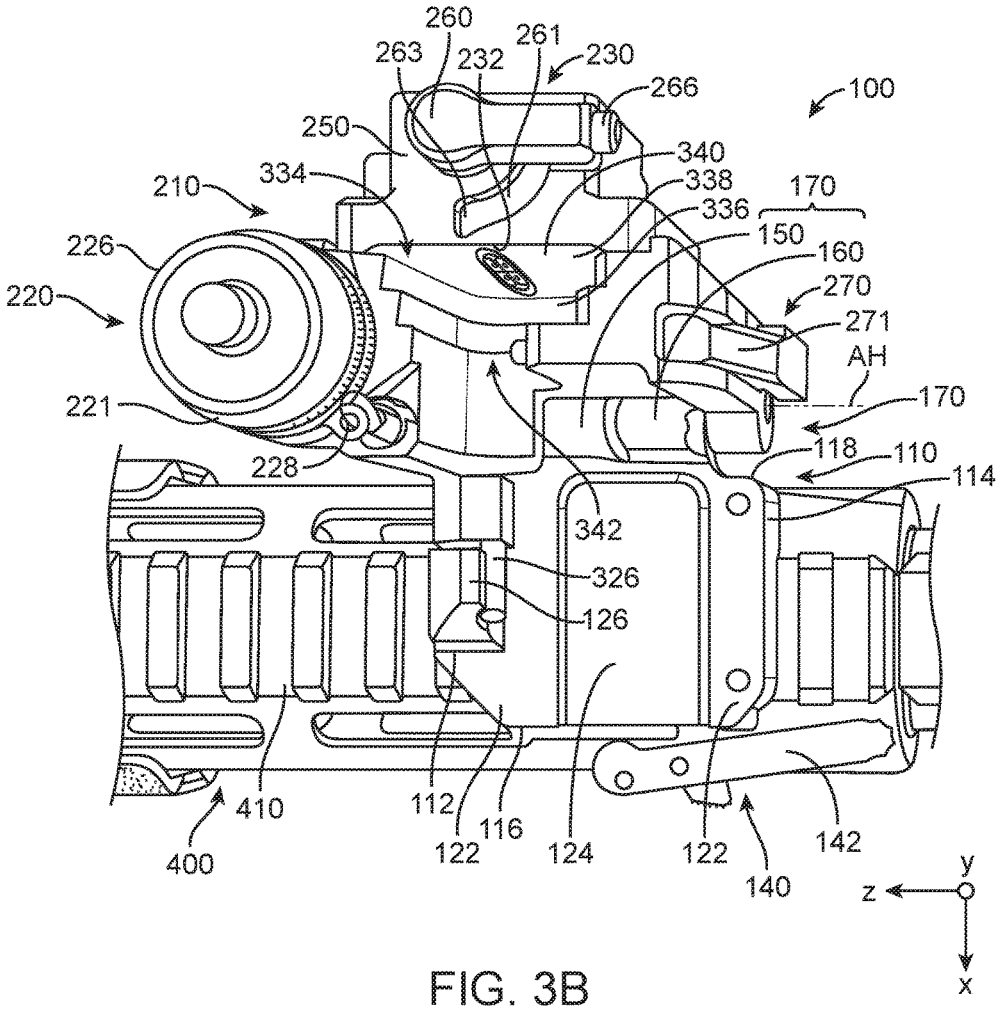
FIG. 3B is a close-up top-down view of the adjustable weapon-based mount as mounted to the rail of a weapon and with the side fixture in the up position.
Figure 3C:
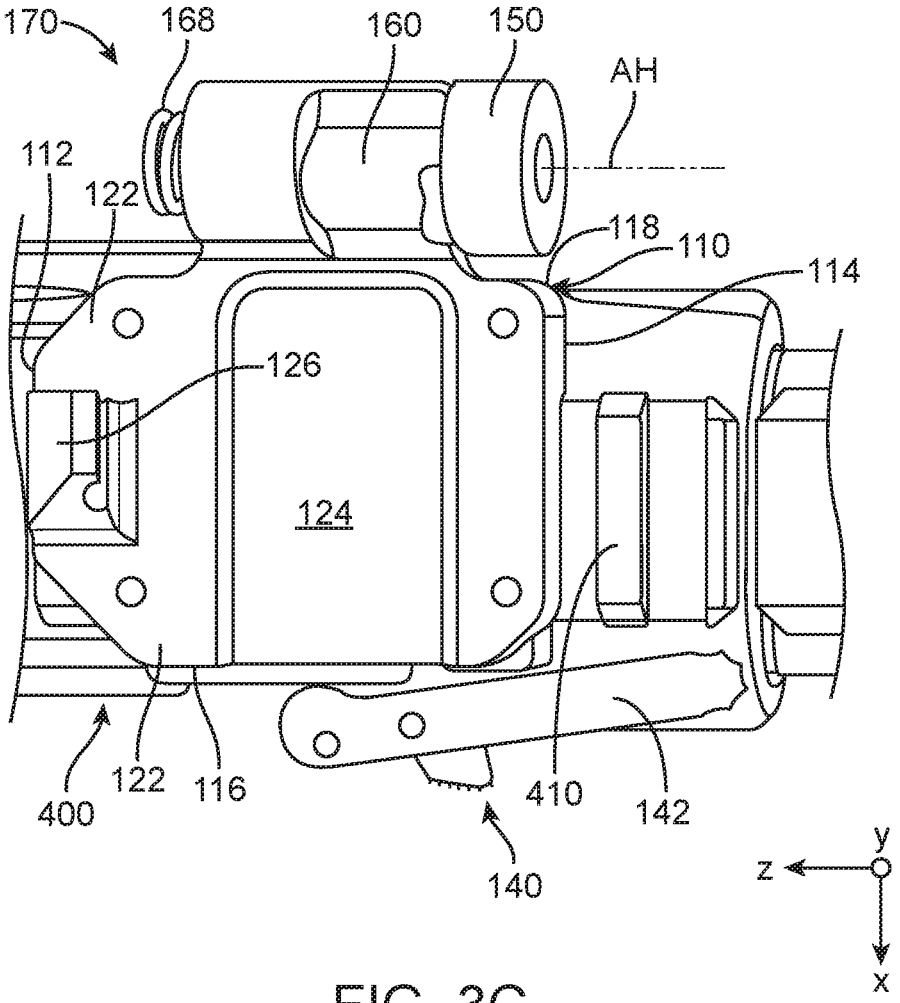
FIG. 3C is a close-up top-down view of the base of the adjustable weapon-based mount and showing an example hinge fixture at one side of the base.

FIG. 3A is a side elevated view of an example adjustable weapon-based mount apparatus ("mount") 100 configured to operably support NV goggle 10 on a weapon. The mount 100 includes two main components: a base 110 and a side fixture 210 rotatably attached to the base. FIG. 3B is a close-up top-down view of mount 100 mounted to a weapon 400 at a rail 410. FIG. 3C is a close-up top-down view of base 110 on rail 410.

The mount 100 is rotatably adjustable, meaning that side fixture 210 can be rotated relative to the base 110 so that the NV goggle 10 can be moved into and out of an in-line position in front of a day optic mounted on weapon 400, as described in greater detail below. Thus, in an example, side fixture 210 is rotatable between two positions: an up or in-line position and a down or out-of-line position. In an example, the up and down positions are separated by a rotation of about 90 degrees (e.g., between 85 and 95 degrees). Other convenient angular separations between the up and down positions can also be used.

The mount 100 is also adjustable in the sense that in an example base 110 is configured so that mount 100 can be rapidly connected to and disconnected from rail 410. In an example, this is accomplished using a clip-on device known in the art of weapon sights, and as described in greater detail below. An example type of clip-on device is a throw-lever rail mounting mechanism, also referred to as a throw-lever rail mount for short.

1. Base

With reference to FIGS. 3A through 3C, base 110 of mount 100 has a front end 112, a back end 114 and opposite sides 116 and 118. The base 110 also includes a top surface 122 with a recess 124. Base 110 also has a bottom surface 132 opposite the top surface. The bottom surface 132 includes a mounting feature 134 such as a longitudinal groove that runs in the y-direction and that is configured to facilitate attaching mount 100 to rail 410 of weapon 400. Base 110 also includes on top surface 122 and adjacent front end 112 an upwardly extending catch member 126 that is one part of a two-part latching mechanism described in greater detail below.

Base 110 also includes at side 116 a clip-on mechanism used to clip base 110 onto and off of rail 410. In an example, clip-on mechanism includes a cam-based lever arm 142 that allows for base 100 to be releasably mounted to rail 410 of weapon 400 by operation of the lever arm.

Base 100 further includes at side 118 at least one hinge feature 150, such as a sleeve or a knuckle, that receives a spring-loaded pin 160 operably supported by side fixture 210 to form a hinge mechanism 170 having a hinge axis AH that lies in the z-direction. The hinge mechanism 170 allows for side fixture 210 to rotate about the hinge axis AH. In an example, the hinge mechanism has a rotation range of about 90 degrees. The hinge mechanism 170 is discussed in greater detail below.

2. Side Fixture

Figure 3D:
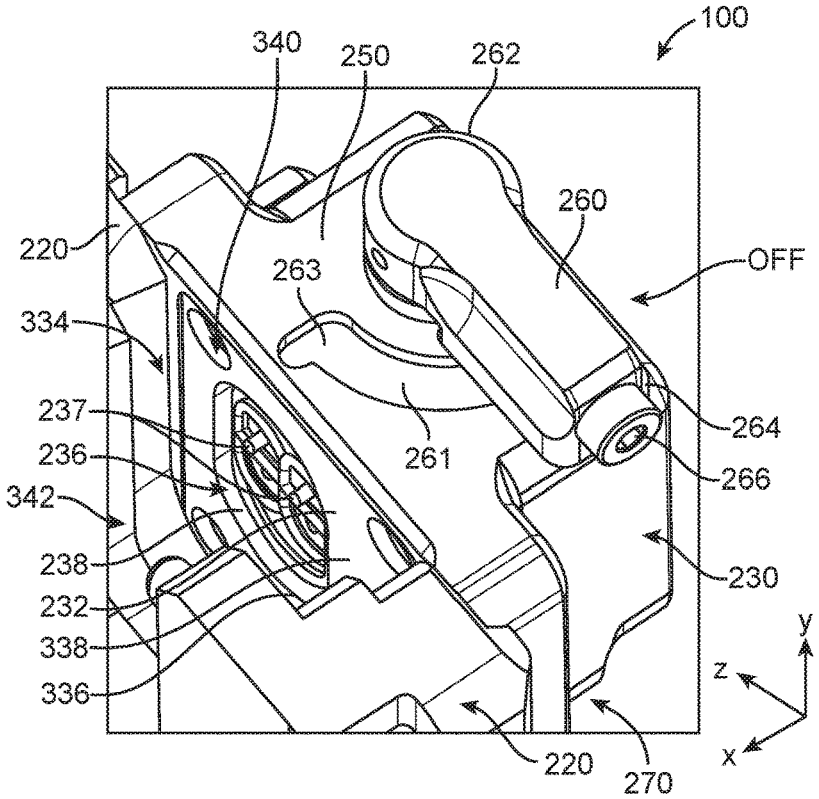
FIGS. 3D and 3E are a close-up top elevated views of the side fixture and showing two different positions of the power switch of the electronics section of the side fixture.
Figure 3E:
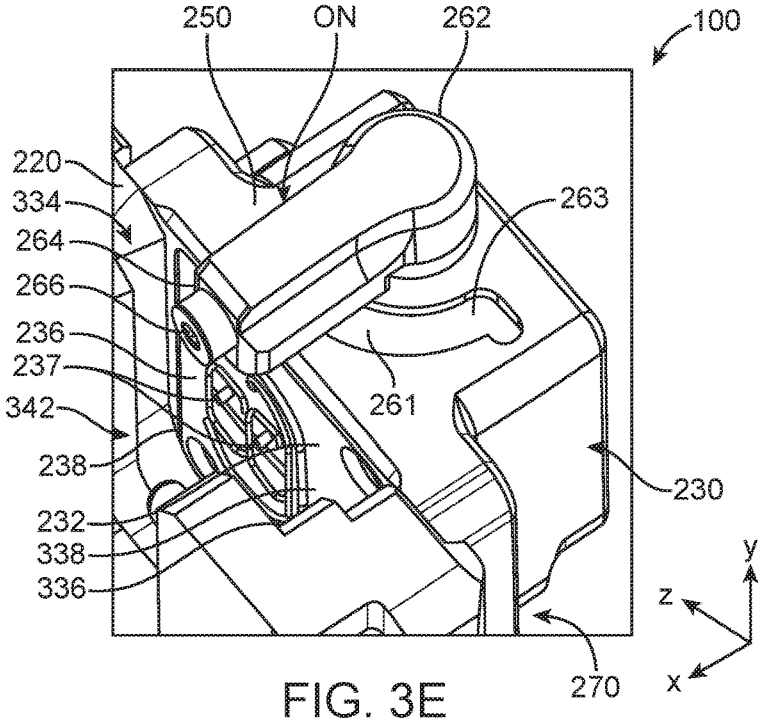
Figure 3F:
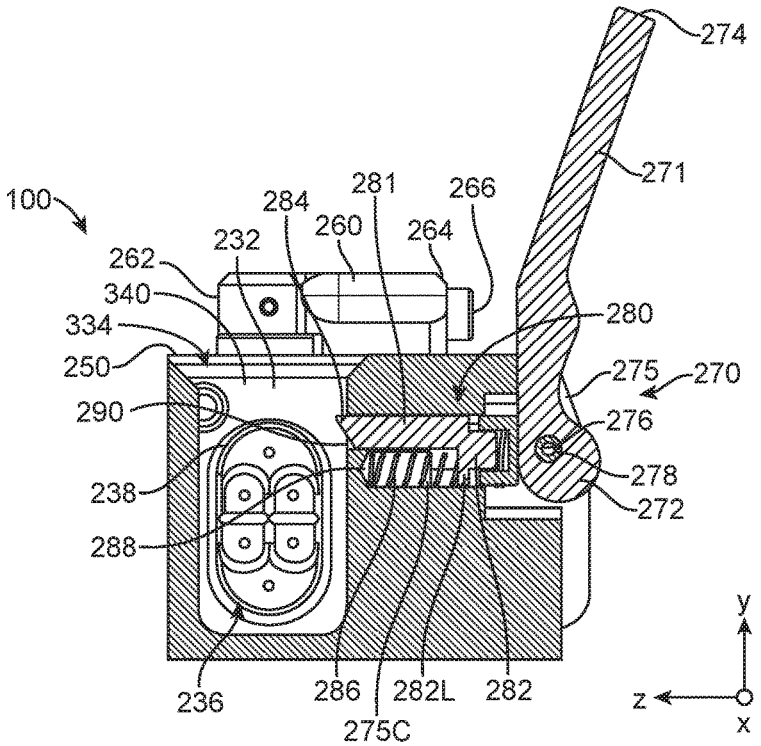
FIGS. 3F and 3G are side views of the side fixture showing the lever arm of the lever section in the up or unlocked position (FIG. 3F) and in the down or locked position (FIG. 3G)
Figure 3G:
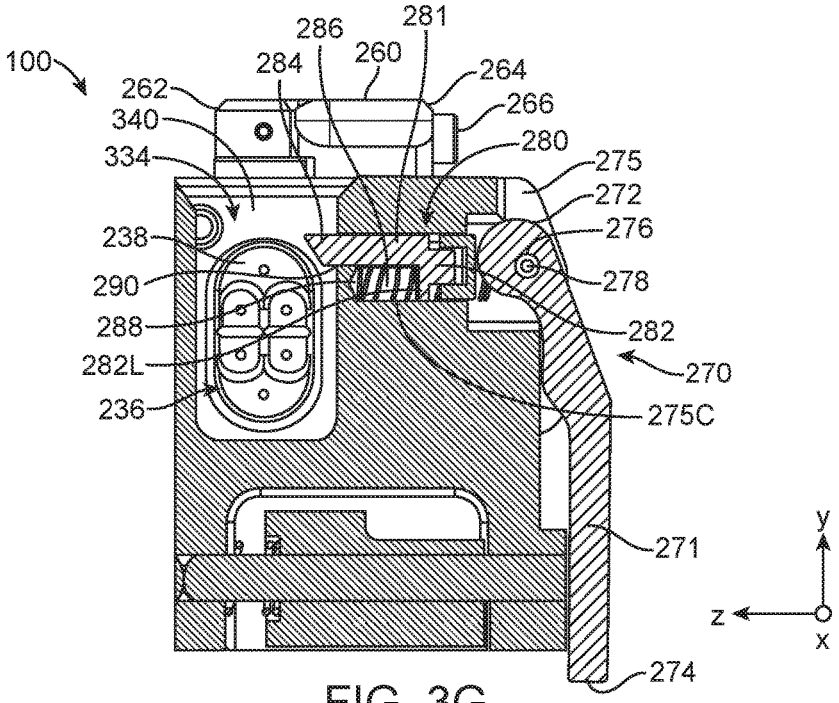

FIGS. 3D and 3E are a close-up top elevated views of side fixture 210. FIG. 3F and FIG. 3G are side cut-away views of side fixture 210. With reference now to FIGS. 3A through 3G, side fixture 210 has three main sections: a battery section 220, an electronics section 230 and a lever section 270. These three sections are arranged to define an open slot 334 that runs in the y-direction and that is configured to slidingly receive and operably engage NV mounting fixture 34 of NV goggle 10 as described below. As best seen in FIGS. 3B, 3D and 3E, an example slot 334 includes and an inner section 336 and an outer section 338, with the outer section residing closest to electronics section 230 and being slightly wider than the inner section. The slot 334 included an end opening 340 and a longitudinal opening 342.

a) Battery Section

With particular reference now to FIGS. 3A and 3B, battery section 220 includes a battery holder 221 configured to hold a battery 222 and provide power to the NV goggle 10 when it is operably arranged in mount 100. This is necessary because a NV goggle is typically powered by a remote power source, e.g., a battery or battery pack attached to the user's helmet. An example battery section 220 can employ the battery holders such as disclosed in U.S. Pat. Nos. 7,576,515 and 7,776,516, which are incorporated herein by reference. The battery 222 can be a AA battery or a CR123 battery or other suitable battery. In an example, battery holder 221 includes a base 224 and a cap 226. In an example, cap 226 is connected to the base or other portion of side fixture 210 with a lanyard 228 so that the cap remains attached to side fixture 210 at all times.

In an example, NV goggle 10 contains its own power source, such as a battery.

b) Electronics Section

With reference once again to FIGS. 3A and 3B, electronics section 230 has a front surface 232 that defines a back wall of slot 234 The front surface 232 includes a second electrical connector 236 configured to operably engage the first electrical connector 36 of NV mounting fixture 34. The example second electrical connector 236 is shown as including two electrical contacts 237 that define a plug-type of electrical connector. In an example, second electrical connector resides in a recess 238 formed in front surface 232. This facilitates the operable engagement of the first electrical connector 36 with the second electrical connector 236 when the NV mounting fixture 34 is inserted into slot 334.

The electronics section 230 also includes power-management electronics 242 configured to receive power from battery 222 of batter section 220 and to provide the electrical power in a controlled manner to NV goggle 10 through second electrical connector 236. In an example, power-management electronics 242 includes a voltage-regulating circuit, such as the type disclosed in aforementioned U.S. Pat. Nos. 7,576,515 and 7,576,516.

The electronics section 230 includes a top side 250 that supports a power switch 260. The power switch 260 has a proximal end 262 and a distal end 264. The power switch 260 is configured to rotate at its proximal end 262 between an OFF position (FIG. 3D) and an ON position (FIG. 3E). In an example, power switch 260 is spring loaded and can only be moved by activating (e.g., depressing) a button 266 located at distal end 264. When the button 266 is not depressed or otherwise activated, the power switched 260 remains locked in place. When power switch 260 is rotated to the ON position, distal end 264 of power switch 260 resides over the end opening 340 of slot 334 (FIG. 3E) and thus serves to inhibit the longitudinal movement of mounting fixture within the slot. In an example, top side 250 includes a curved groove 261 with retention features 263 at opposite ends of the curved groove that releasably retain power switch 260 in the ON and OFF positions. The power switch 260 is released from retention features 263 by activating button 266.

With continuing reference to FIGS. 3D and 3E, in an example, power switch 260 is mechanically connected to electrical contacts 237 and is configured to control movement electrical contacts 237 of second electrical connector 236 by the movement of the power switch. In an example, when the power switch 260 is in the OFF position, the electrical contacts 237 are in a retracted position, which facilitate the insertion of NV mounting fixture 34 into slot 334. When the power switch 260 is in the ON position, the electrical contacts 237 are in an extended position so that they can engage with corresponding receptacle ports 37 of first electrical connector 36 when the NV mounting fixture 34 of NV goggle 10 is operably arranged within slot 334.

c) Lever Section

With reference now particularly to FIGS. 3F and 3G, the lever section 270 configured to secure (lock) NV goggle 10 to mount 100. The lever section 270 includes a lever arm 271 having proximal end 272 and a distal end 274. The proximal end 272 includes a hole 276 through which a pin 278 extends and around which lever arm 271 can rotate relative to support member 275. In an example, proximal end 272 has an asymmetric shape that provides a cam action when lever arm 271 is rotated (i.e., lever arm constitutes a cam lever). Pin 278 is supported by a body portion 275 of lever section 270.

The proximal end 272 of lever arm 271 mechanically engages a spring-loaded locking device 280 disposed in a cavity 275C within support body 275. The spring-loaded locking device 280 includes a rod 281 having a proximal end 282 and a distal end 284, and a resilient member 286. The proximal end 282 of rod 281 is in contact with proximal end 272 of lever arm 271. The proximal end 282 of rod 281 includes a downwardly depending ledge 282L against which one end of resilient member 286 makes contact. The other end of resilient member 286 is in contact with an interior wall 288 of support body 275 that in part defines an output end 290 of cavity 275C. The output end 290 is in communication with (i.e., opens to) slot 334.

The rod 281 is horizontally movable within cavity 282. The resilient member 286 provides a horizontally directed force that urges the rod towards proximal end 272 of lever arm 271. With reference to FIG. 3F, when the lever arm 271 is in the "up" or "unlocked" position, the narrow portion of proximal end 272 of lever arm 271 is in contact with proximal end 282 of rod 281. The action of resilient member 286 places rod 281 in a retracted position within cavity 275C, wherein the distal end 284 remains within cavity 275C or only slightly extends from output end 290 of the cavity.

When lever arm 271 is rotated to the "down" or "locked" position, the wide portion of proximal end 272 of lever arm 271 is in contact with proximal end 282 of rod 281. The cam action of lever arm 271 overcomes the opposing horizontal force of resilient member 286 and causes the distal end 284 to extend from end opening 290 of cavity 275C and into slot 334. The distal end 284 of rod 281 engages side notch 42S of flange 36 of NV mounting fixture 34 when the mounting fixture is operably arranged within slot 334, thereby locking NV goggle 10 to mount 100, as explained in greater detail below. The NV goggle 10 is omitted from FIGS. 3F and 3G for ease of illustration and explanation of the lever section 270.

d) Hinge Mechanism

Figure 4A:
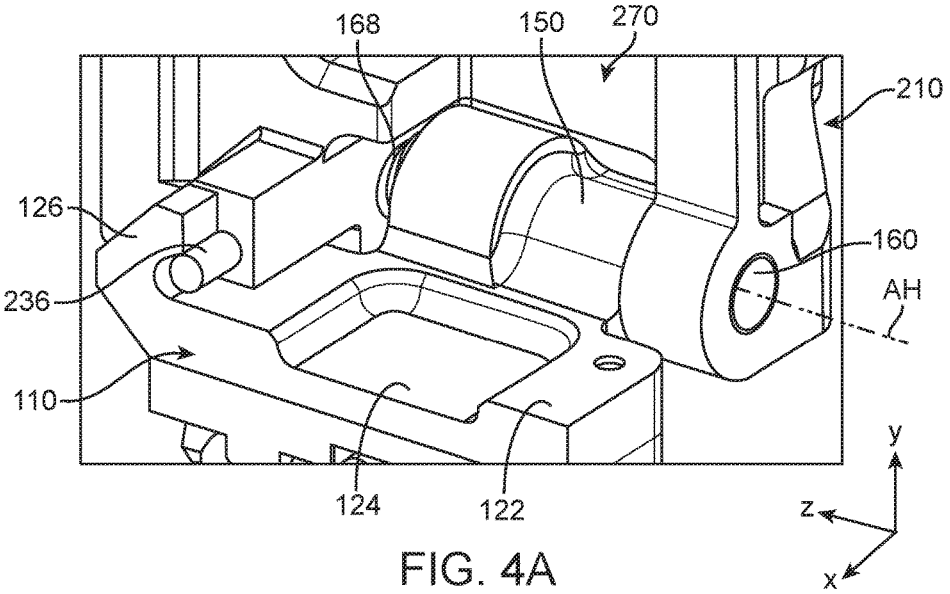
FIG. 4A through 4C are close-up views of the base and the hinge mechanism that rotatably attaches the base to the side fixture.
Figure 4B:
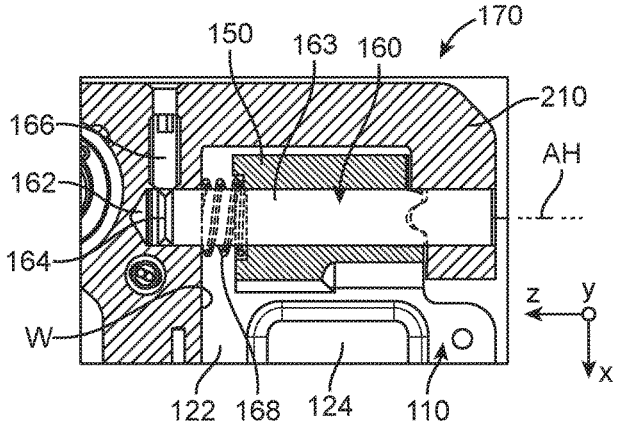
Figure 4C:
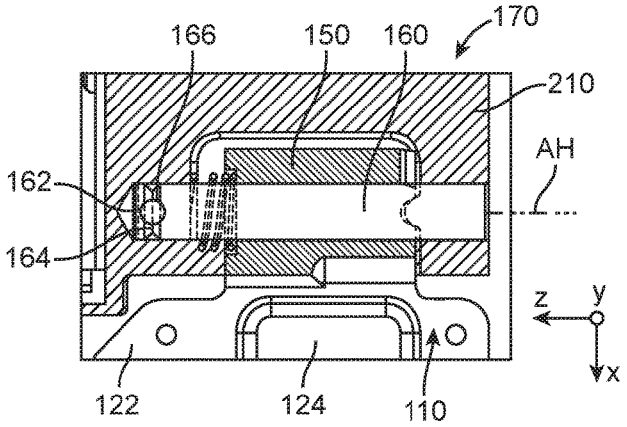

FIGS. 4A through 4C are close-up views of hinge mechanism 170 introduced and discussed above. The hinge mechanism 170 includes the aforementioned pin 160. The pin 160 has a proximal end 162 and an outer surface 163 with a circular groove 164 formed in the outer surface near the proximal end. A retaining feature 166 supported by side fixture 210 allows pin 160 to rotate about its longitudinal axis AH while constraining longitudinal movement of the pin. A resilient member 168 resides over a portion of pin 160 at proximal end 162 and presses against the knuckle 150 of base 110 and a vertical wall W of side fixture 210.

With particular reference to FIG. 4A, side fixture 210 also includes a latch feature 326 that extends horizontally and is configured to engage catch member 126 when the side fixture 210 is in the up position, as also shown in FIG. 3A. The force of resilient member 168 pushes latch feature 326 against catch member 126, thereby causing the latch feature and the catch member to latch and inhibit rotation of side fixture 210 relative to base 110.

Figure 5:
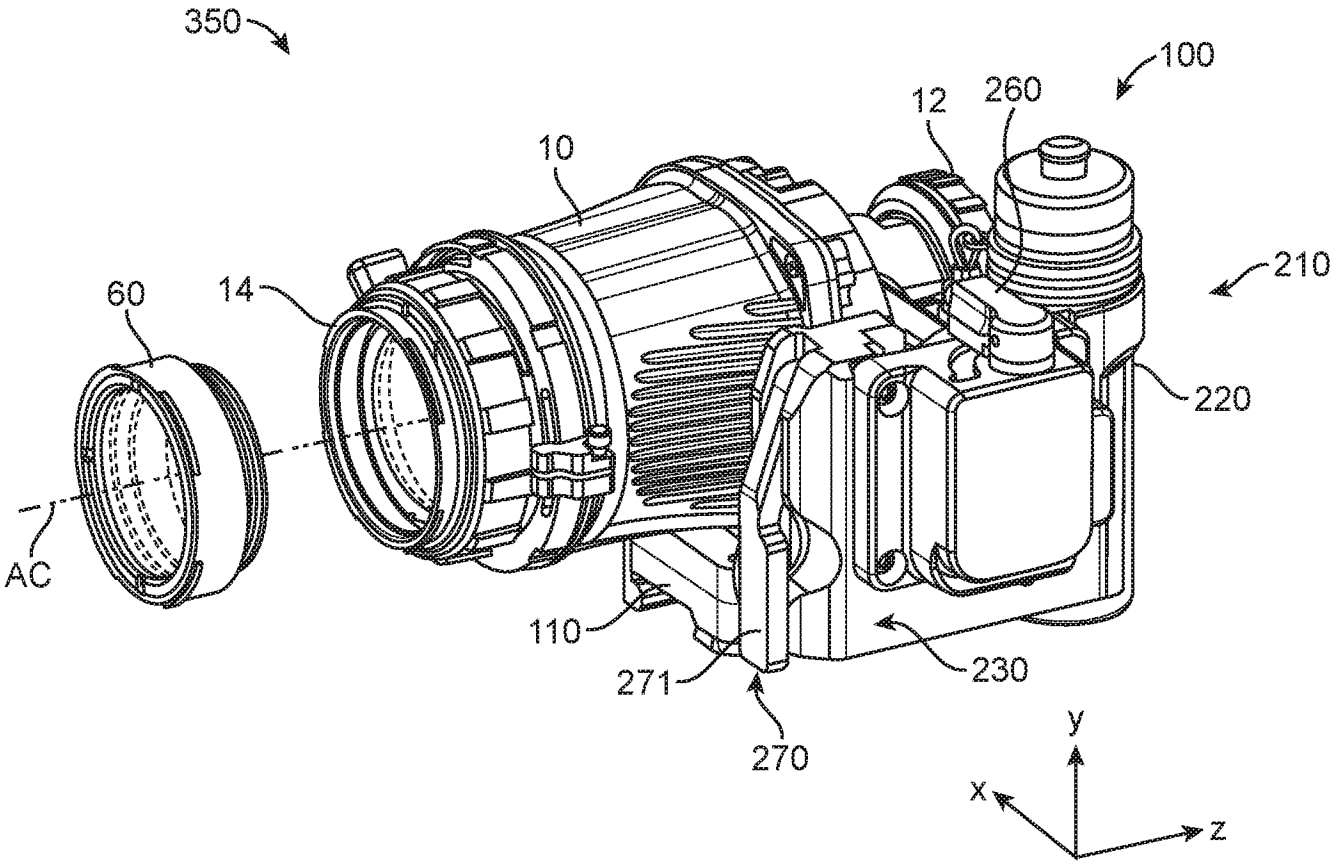
FIG. 5 is a side elevated view of the NV goggle attached to the adjustable weapon-based mount to form an NV weapon sight.

FIG. 5 is similar to FIG. 3A and shows the mount 100 with side fixture 210 in the up position and with NV goggle 10 operably disposed on the mount and attached to the side fixture. The combination of mount 100 and NV goggle constitutes a NV weapon sight 350.

e) Side Fixture Positioning.

In order to change the position of side fixture 210 (and NV goggle 10 if attached thereto) from the up position to the down or "flipped" position, the user urges the NV goggle 10 (or the side fixture if no NV goggle is present) in the −z-direction, i.e., against the direction of the force of resilient member 168, to unlatch latch feature 326 from catch member 226. This allows side fixture 210 to rotate about hinge axis AH relative to base 110 via hinge mechanism 170. The side fixture 210 (and the NV goggle 10 if attached thereto) can be placed back into the up position by rotating the side fixture and allowing the latch feature 326 to engage catch member 126 due to the spring-loaded feature of this latching mechanism so that the side fixture is once again latched in place.

Weapon Sight System Using NV Goggle

As discussed above, mount 100 is configured to clip on to rail 410 of weapon 400 so that the NV goggle 10 can be used on the weapon as part of a weapon sight system, in addition to being used in stand-alone fashion on a helmet or held by hand. Thus, in practice, a user can unmount the NV goggle 10 from helmet mounting fixture 8 on their helmet 6 and add the NV goggle to the weapon as a WM night optic and vice versa using mount 100. The NV goggle 10 can also be removed from storage and added to mount 100. The NV goggle 10 and wedge-prism assembly 60 (when adjusted to correct for the image position) serves as a clip-on weapon sight that allows for night vision without disturbing the bullet impact point of the day sight (day optic).

Figure 6A:
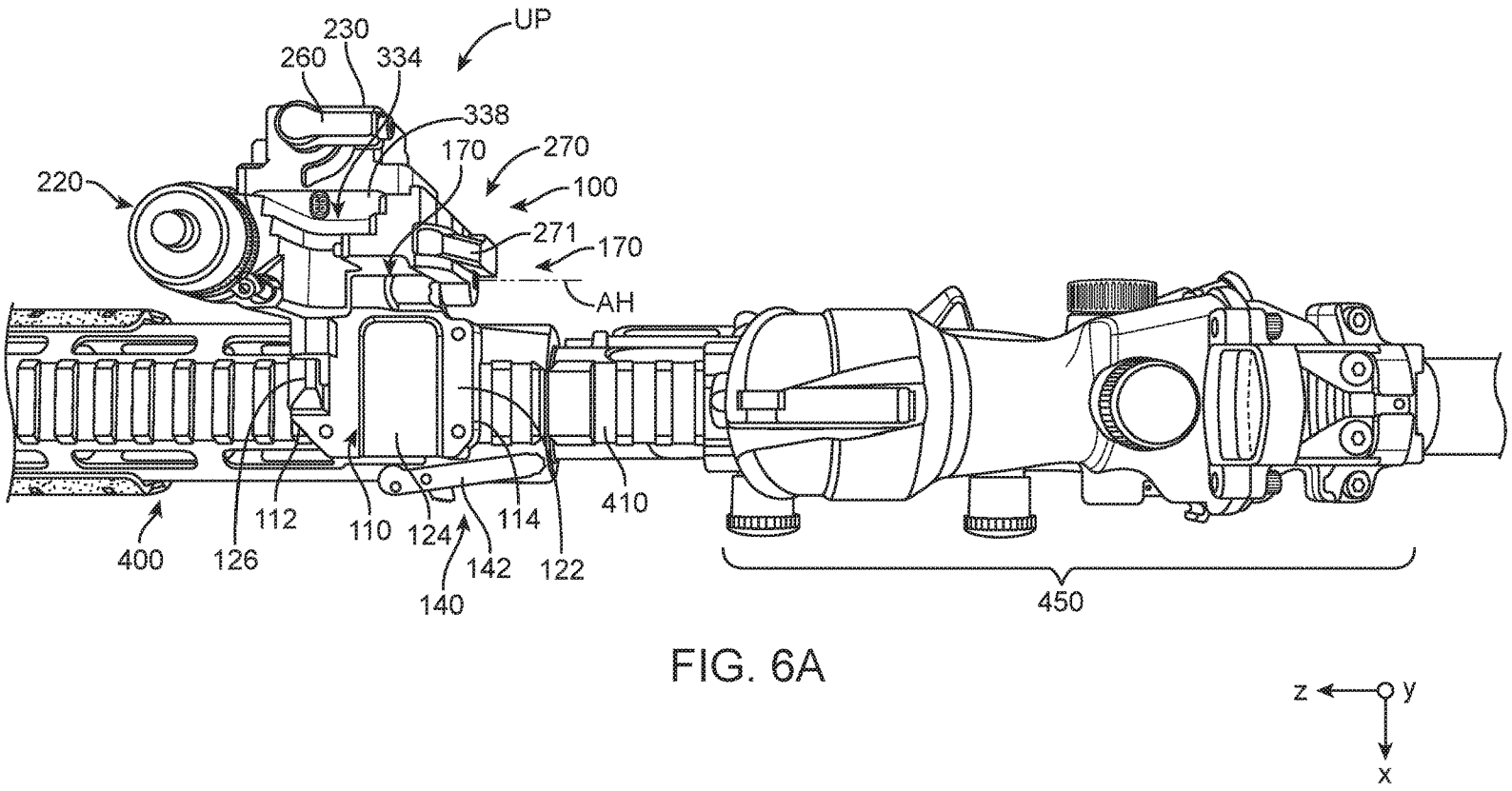
FIGS. 6A and 6B are top-downs views that show the adjustable mount as mounted to the rail of a weapon, with FIG. 6A showing the side fixture in the up (i.e., in-line) position and FIG. 6B showing the side fixture in the down (i.e., out-of-line) position.
Figure 6B:
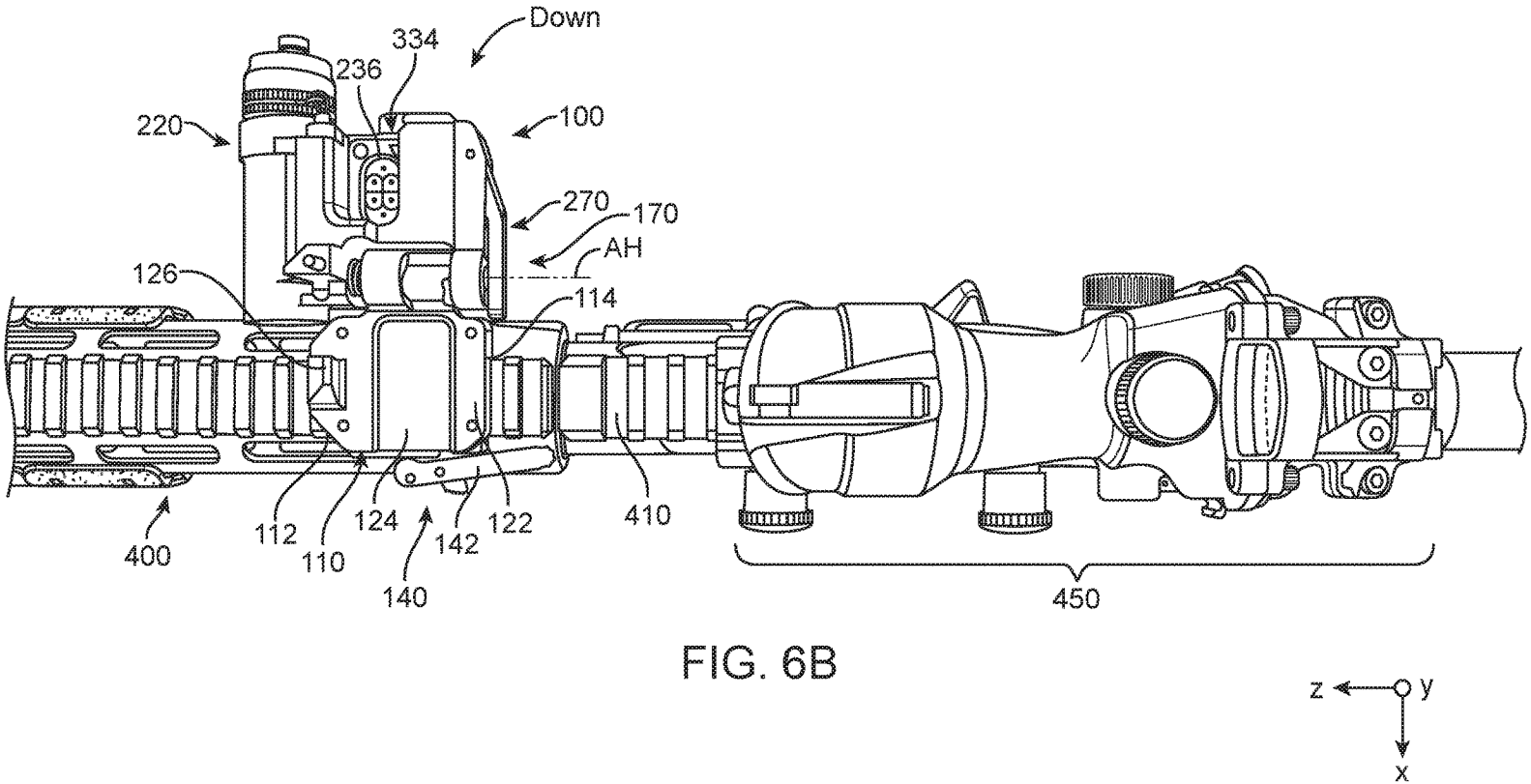

FIG. 6A and FIG. 6B are top-downs views that show mount 100 mounted to rail 410 of weapon 400. In an example, weapon 400 is a rifle, and rail 410 is a military-standard rail. The rail 410 also operably supports a day sight 450. FIG. 6A shows mount 100 in the up position while FIG. 6B shows mount 100 in the down position, i.e., with the side fixture flipped over so that it resides at the side of weapon 400 and out of the line of sight of day sight (day optic) 450.

Figure 7A:
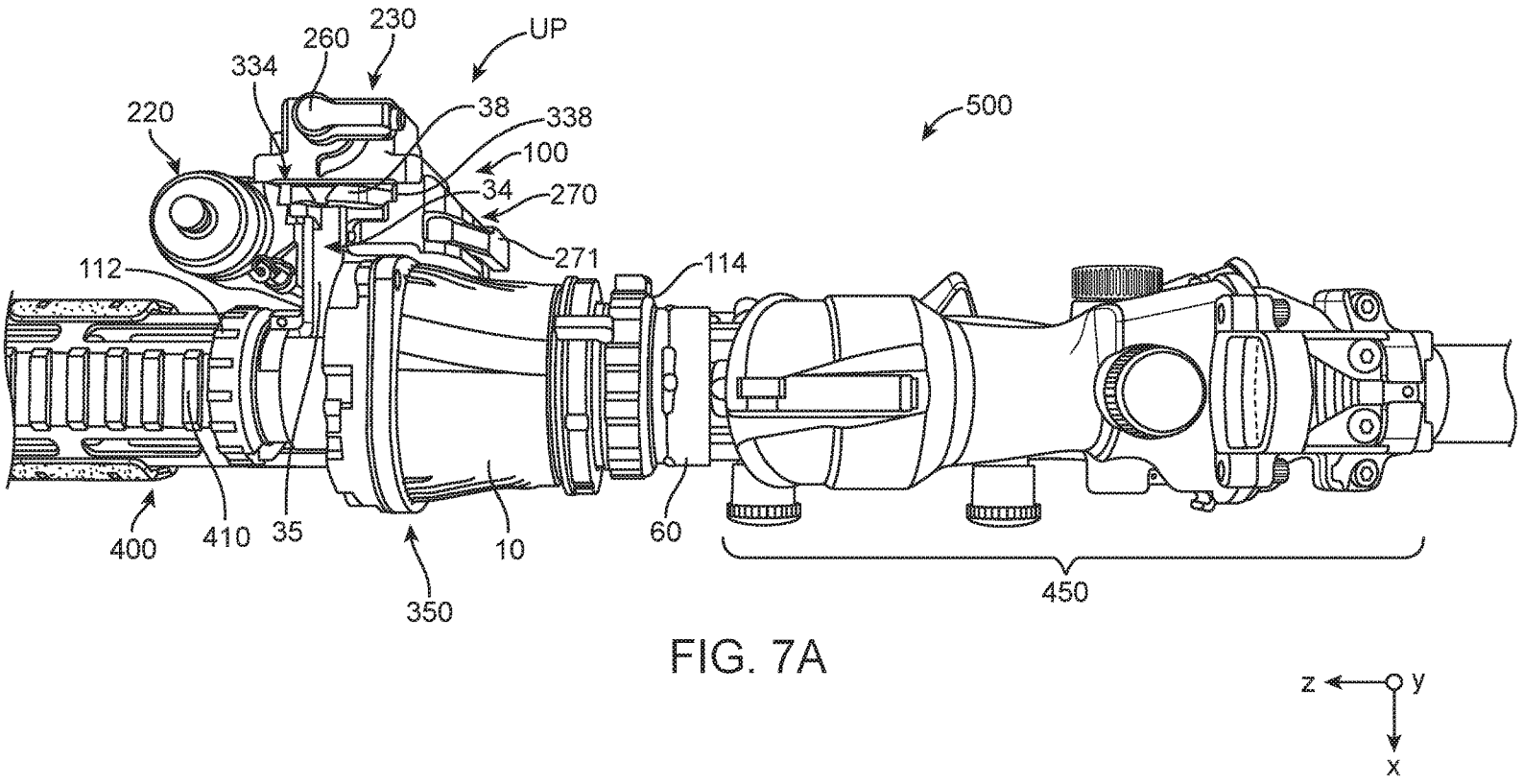
FIGS. 7A and 7B are similar to FIGS. 6A and 6B except that the NV goggle is mounted to the adjustable weapon-based mount.
Figure 7B:
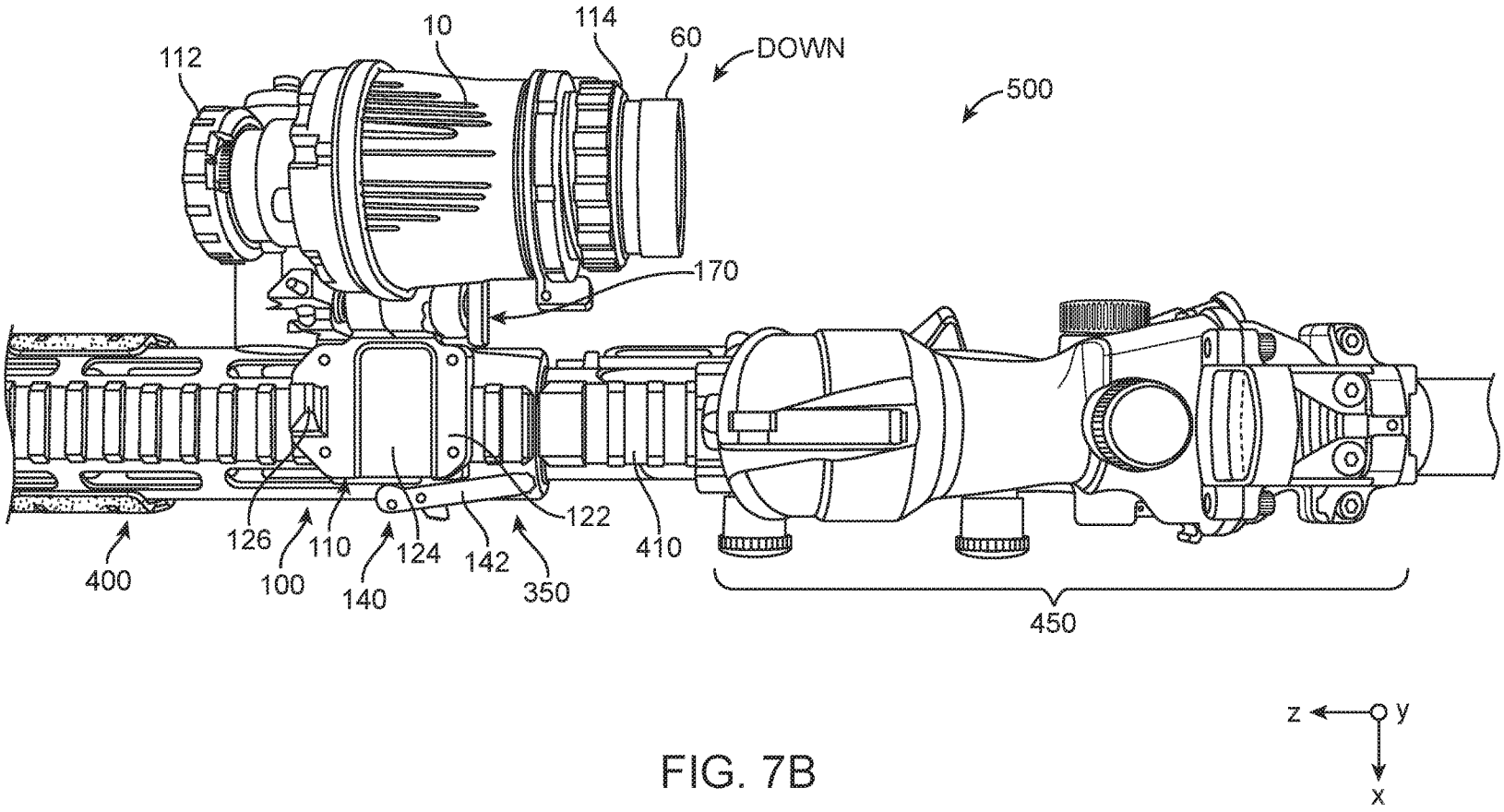

FIGS. 7A and 7B are similar to FIGS. 6A and 6B except that now NV goggle 10 is secured within mount 100. This is accomplished by inserting the NV mounting fixture 34 of the NV goggle into slot 334 of side fixture 210, with the inner flange 36 residing in inner slot 336 and the outer flange 38 residing in outer slot 338, as shown in the close-up to-down view of FIG. 2B. In this position, the first electrical connector 46 of NV goggle 10 confronts second electrical connector 236 of side fixture 210.

Once NV mounting fixture 34 of NV goggle 10 is properly seated within slot 334, the power switch can be set to the on position. This causes electrical contacts 237 of second electrical connector 236 to be extended and received by the receptacle ports 47 of first electrical connector 46. This establishes electrical communication between mount 100 and NV goggle 10 so that battery section 220 and electronics section 230 can power the NV goggle.

Figure 8A:
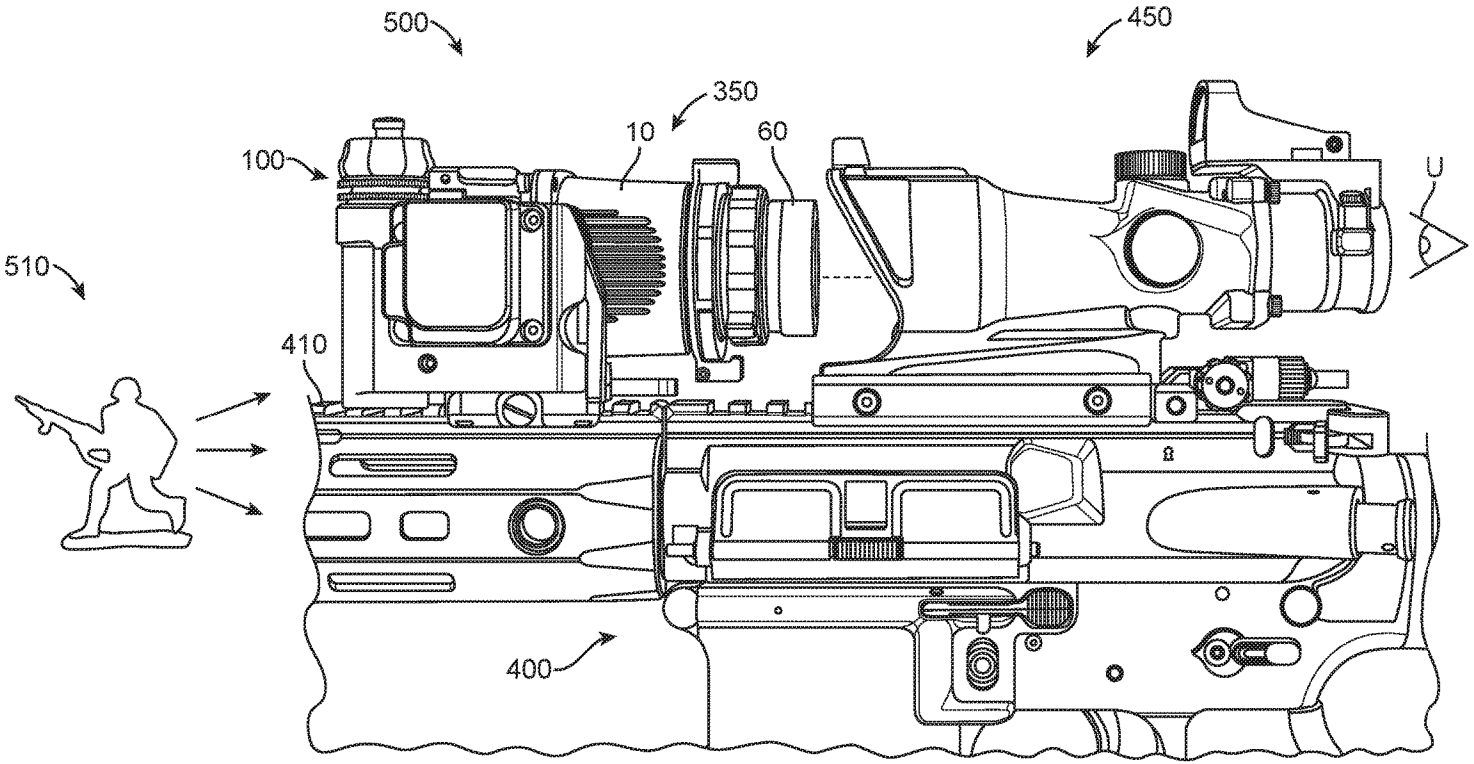
FIG. 8A is side view of an example weapon sight system as disclosed herein that includes a day optic disposed in line with the NV goggle as supported by the adjustable weapon-based mount, and also showing a user viewing a scene through the weapon sight system.
Figure 8B:
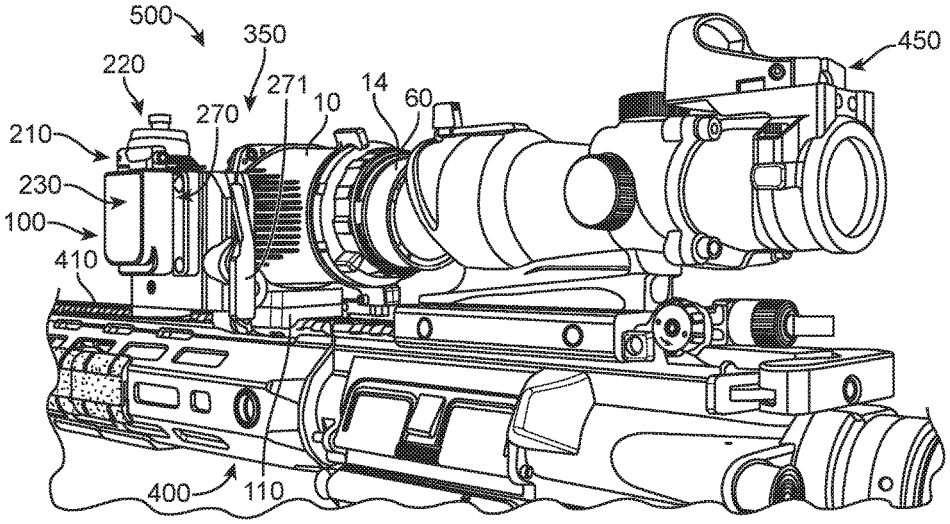
FIGS. 8B and 8C are front and back elevated views, respectively, of the example weapon sight system shown in FIG. 8A.
Figure 8C:
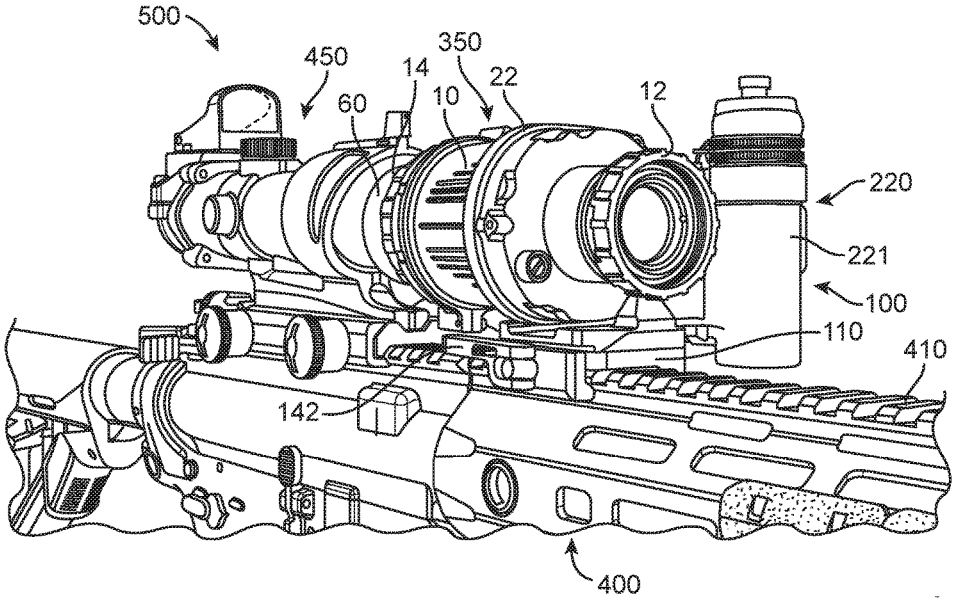

FIG. 8A is a side view and FIGS. 8B and 8C are front and back elevated views, respectively, of a weapon sight system 500 formed by NV goggle 10, mount 100 and day sight 450, with the NV google arranged in-line and in front of the day sight. In the example of FIGS. 8A through 8C, the mount 100 is arranged so that side fixture 210 rotates to the left or counter-clockwise when looking down the barrel of weapon 400, i.e., in the z-direction. It is noted that mount 100 can also be arranged so that fixture 210 rotates to the right or counter-clockwise, such as shown in the other Figures.

In one example, a user U views a scene 510 during the day time through day sight 450 only by positioning the NV goggle 10 out of the line of sight of the day sight 450 (i.e., in the down position) by using mount 100 in the manner described above. In another example, the user views scene 510 at night time through both the day sight 450 and NV goggle 10 by having the NV goggle in the up or viewing position.

With reference also to FIG. 1, in an example, the user U removes the NV goggle 10 from helmet mounting fixture 8 on helmet 6 and then attaches the NV goggle to weapon 400 using mount 100, which already has been secured to rail 410. This process includes making sure that the lever arm 271 of lever section 270 is in the open or up position when receiving NV goggle 10 and then moving the lever arm to the down or closed position to lock the NV goggle in place. Once the NV goggle is secured to mount 100, the NV goggle is then powered by activating power switch 260 as discussed above. The NV goggle 10 can also be readily removed from mount 100 and replaced on helmet 6 by reversing this procedure.

It will be apparent to those skilled in the art that various modifications to the preferred embodiments of the disclosure as described herein can be made without departing from the spirit or scope of the disclosure as defined in the appended claims. Thus, the disclosure covers the modifications and variations provided they come within the scope of the appended claims and the equivalents thereto.

What is claimed is:

1. A weapon-based mount apparatus in combination with a night-vision monocular goggle ("NV goggle") having a mounting fixture with a first electrical connector, for mounting on a weapon having a rail comprising: a base configured to releasably mount to the rail of the weapon; and a side fixture rotatably mounted to a side of the base, the side fixture having: i) a battery section that operably supports a battery; ii) an electronics section electrically connected to the battery section and that includes power-management electronics electrically connected to a second electrical connector; iii) a slot configured to receive the mounting fixture so that the first and second electrical connectors operably engage when the NV goggle is operably supported by the side fixture; and iv) a lever section configured to lock the NV goggle within the slot.

2. The weapon-based mount apparatus according to claim 1, wherein the base includes a clip-on mechanism having a cam-based lever that is moveable to engage and disengage with the rail.

3. The weapon-based mount apparatus according to claim 1, wherein the side fixture is attached to the base with a hinge mechanism so that the side fixture is rotatable by about 90 degrees relative to the base.

4. The weapon-based mount apparatus according to claim 1, wherein the slot has an open end, and wherein the electronics section includes a power switch that rotates between an off position and an on position, and wherein in the on position a portion of the power switch covers the open end of the slot.

5. The weapon-based mount apparatus according to claim 1, wherein the top surface of the base includes a recess sized to accommodate a bottom portion of the NV goggle.

6. The weapon-based mount apparatus according to claim 1, wherein the base includes a first latch feature and the side fixture includes a second latch feature, and wherein the first and second latch features are configured to releasably engage when the side fixture is at right angles to the base.

7. The weapon-based mount apparatus according to claim 6, wherein the second latch feature is a spring-loaded.

8. The weapon-based mount apparatus according to claim 1, wherein the lever section includes a locking lever that operably engages a spring-loaded locking device having a rod, and where the locking lever is configured to move an end of the rod into and out of the slot.

9. The weapon-based mount apparatus, wherein the mounting fixture is configured to mount to a helmet mounting fixture.

10. A night-vision weapon sight, comprising:

the weapon-based mounting apparatus according to claim 1; and the NV goggle operably mounted to the weapon-based mount.

11. A weapon-sight system for a weapon having a rail, comprising:

the weapon-based mounting apparatus according to claim 1 mounted to the rail;

a NV goggle operably supported by the weapon-based mounting apparatus; and a day sight mounted to the rail in-line and downstream of the NV goggle.

12. The weapon-sight system according to claim 11, wherein the day sight has a bullet impact point, and further comprising:

a wedge-prism assembly attached to a back end of the NV goggle and configured to maintain the bullet impact point.

* * * * *